US011006708B1

(12) United States Patent
Hoyes

(10) Patent No.: US 11,006,708 B1
(45) Date of Patent: May 18, 2021

(54) CANE SEAT ASSEMBLY

(71) Applicant: Dave Hoyes, Danville, PA (US)

(72) Inventor: Dave Hoyes, Danville, PA (US)

( * ) Notice: Subject to any disclaimer, the term of this patent is extended or adjusted under 35 U.S.C. 154(b) by 286 days.

(21) Appl. No.: 16/006,904

(22) Filed: Jun. 13, 2018

Related U.S. Application Data

(60) Provisional application No. 62/541,919, filed on Aug. 7, 2017.

(51) Int. Cl.
*A45B 5/00* (2006.01)
*A45B 3/00* (2006.01)
*A47C 13/00* (2006.01)

(52) U.S. Cl.
CPC ..... *A45B 5/00* (2013.01); *A45B 3/00* (2013.01); *A47C 13/00* (2013.01)

(58) Field of Classification Search
CPC ..... A47C 9/06; A47C 9/10
USPC ..... 297/451.4
See application file for complete search history.

(56) References Cited

U.S. PATENT DOCUMENTS 1,131,540 A * 3/1915 Nerenhausen ..... A61G 5/10 248/230.2
3,131,964 A * 5/1964 Reed ..... B60N 2/38 297/13
3,976,273 A * 8/1976 Kussow ..... A47C 9/04 248/218.4
5,295,727 A * 3/1994 Kao ..... B62J 1/08 248/180.1
6,224,153 B1 * 5/2001 Vodinh ..... A47C 9/06 248/240
7,815,156 B2 * 10/2010 Yang ..... B62J 11/00 248/218.4
2004/0070241 A1 * 4/2004 Ventimiglia ..... A47C 15/004 297/217.1

* cited by examiner

*Primary Examiner* — Sarah B McPartlin
(74) *Attorney, Agent, or Firm* — John J. Elnitski, Jr.

(57) ABSTRACT

A cane seat assembly adapted to be mounted on a cane used to provide support to a user. The cane seat assembly includes a seat adapted to provide a surface to support the user in a sitting position. The cane seat assembly includes a bracket assembly adapted to mounted to the cane. The bracket assembly is configured to receive and support said seat.

8 Claims, 14 Drawing Sheets

CANE SEAT ASSEMBLY

This application claims the benefit of and incorporates by reference U.S. Provisional Application No. 62/541,919 filed Aug. 7, 2017.

BACKGROUND

The present invention generally relates to portable seats. More specifically, the present invention relates to portable seats that attach to canes used while walking by a user.

Disabled people forced to use canes to aid in walking are faced with obstacles on a daily basis that most of us take for granted. Simple travel from place to place becomes a major undertaking that requires considerable effort. Fortunately, the public is becoming increasingly aware of the difficulties that these people face and are responding in a positive manner. Unfortunately, however, there are many aspects in which our society has failed to respond thus far in addressing this issue. Access for the disabled doesn't just mean being able to get inside the door, it means being able to do so with a relative amount of comfort. A prime example of this situation is that many times waiting in lines is involved. These lines can be found in grocery stores, banks, license bureaus, and the like where there are no seating areas provided in lines. Additionally, the wait may be from a few minutes to thirty minutes or more, which is extremely uncomfortable, if not impossible, for many disabled people. Accordingly, there is a need for a means by which disabled people can have access to seating areas while waiting in lines with greater ease and efficiency. Prior art combined canes and seats have failed to provide an adequate solution as they are big and bulky and do not position the seat in relation to the cane shaft to provide proper support, especially for heavier users It is an object of the present invention to provide a compact portable seat that attaches to a cane which provides proper support for the user.

SUMMARY

A cane seat assembly adapted to be mounted on a cane used to provide support to a user. The cane seat assembly includes a seat adapted to provide a surface to support the user in a sitting position. The cane seat assembly includes a bracket assembly adapted to mounted to the cane. The bracket assembly is configured to receive and support said seat.

DETAILED DESCRIPTION OF THE INVENTION

Figure 1:
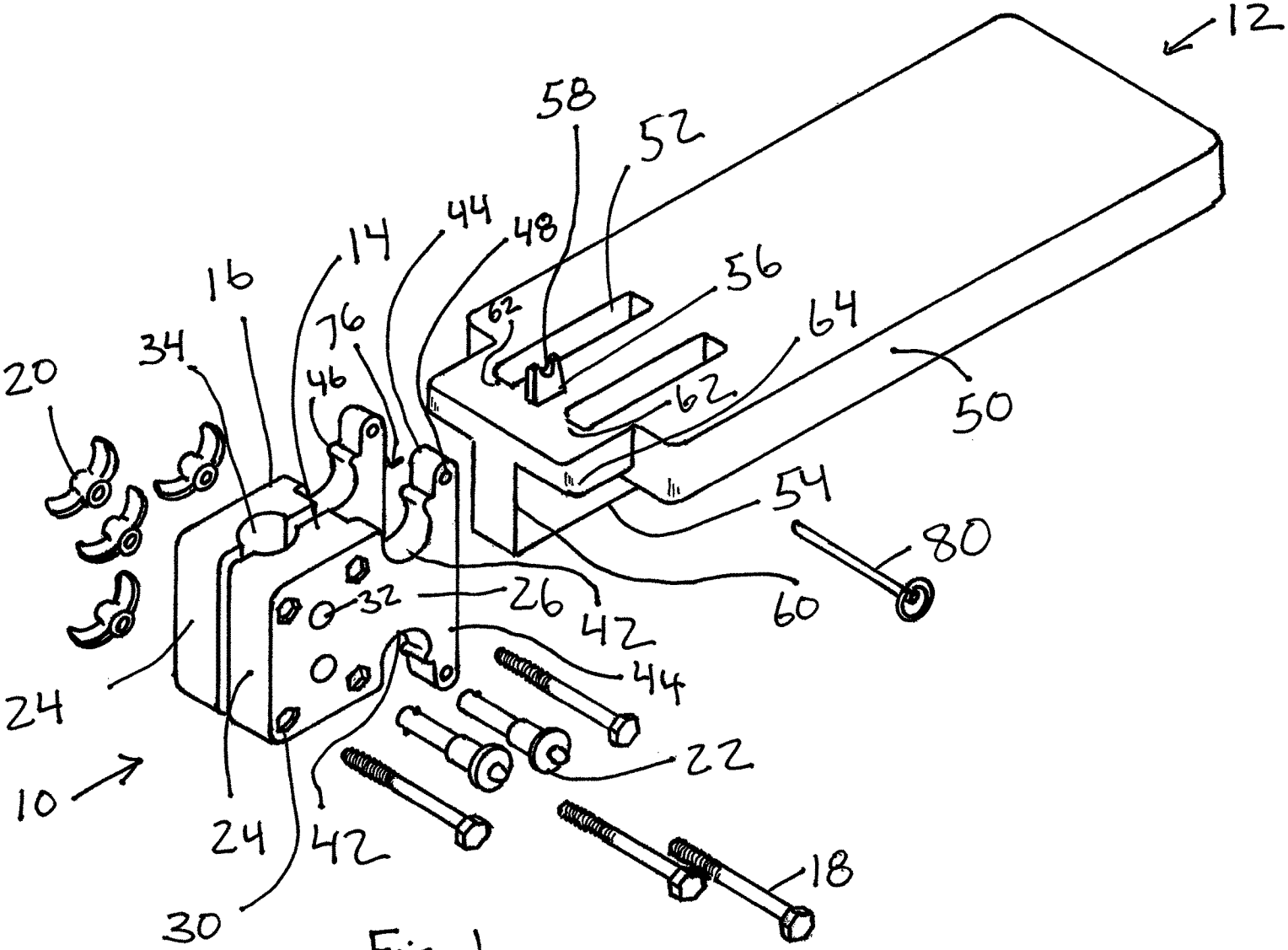
FIG. 1 is a perspective view of a cane seat assembly according to the present invention.
Figure 2:
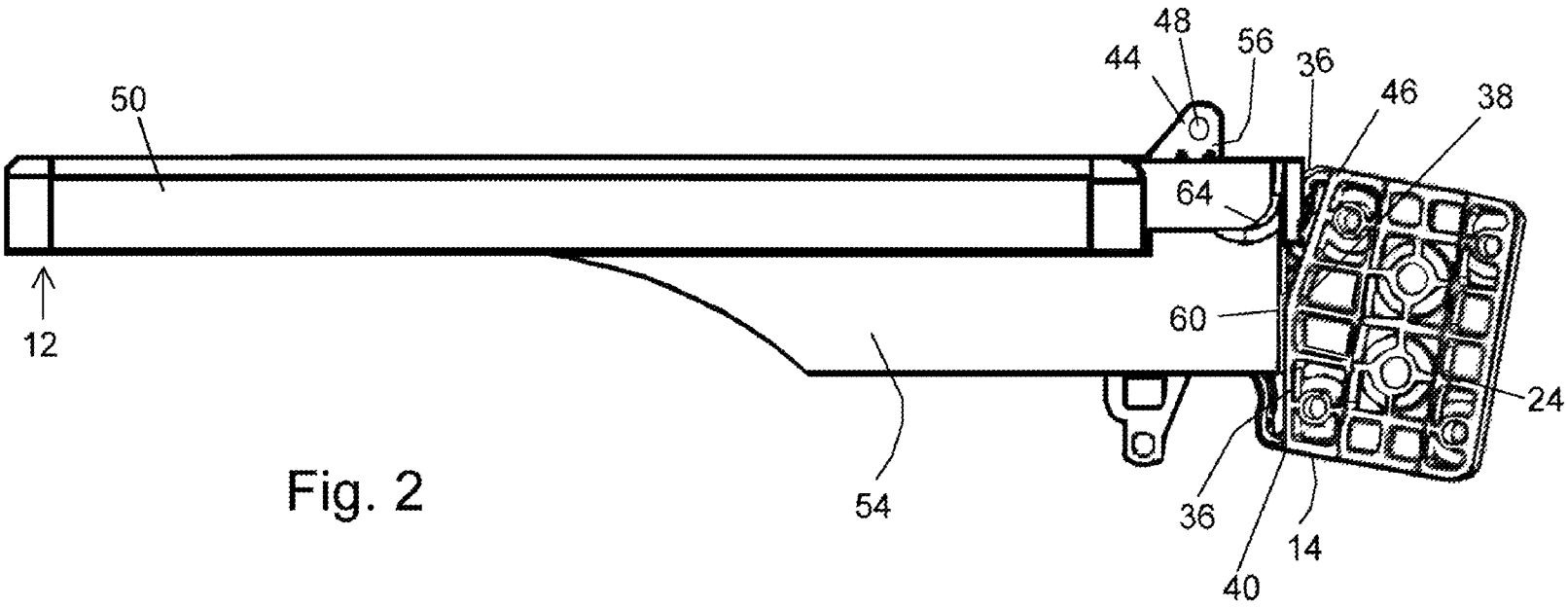
FIG. 2 is a side view of a cant seat assembly according to the present invention.
Figure 3:
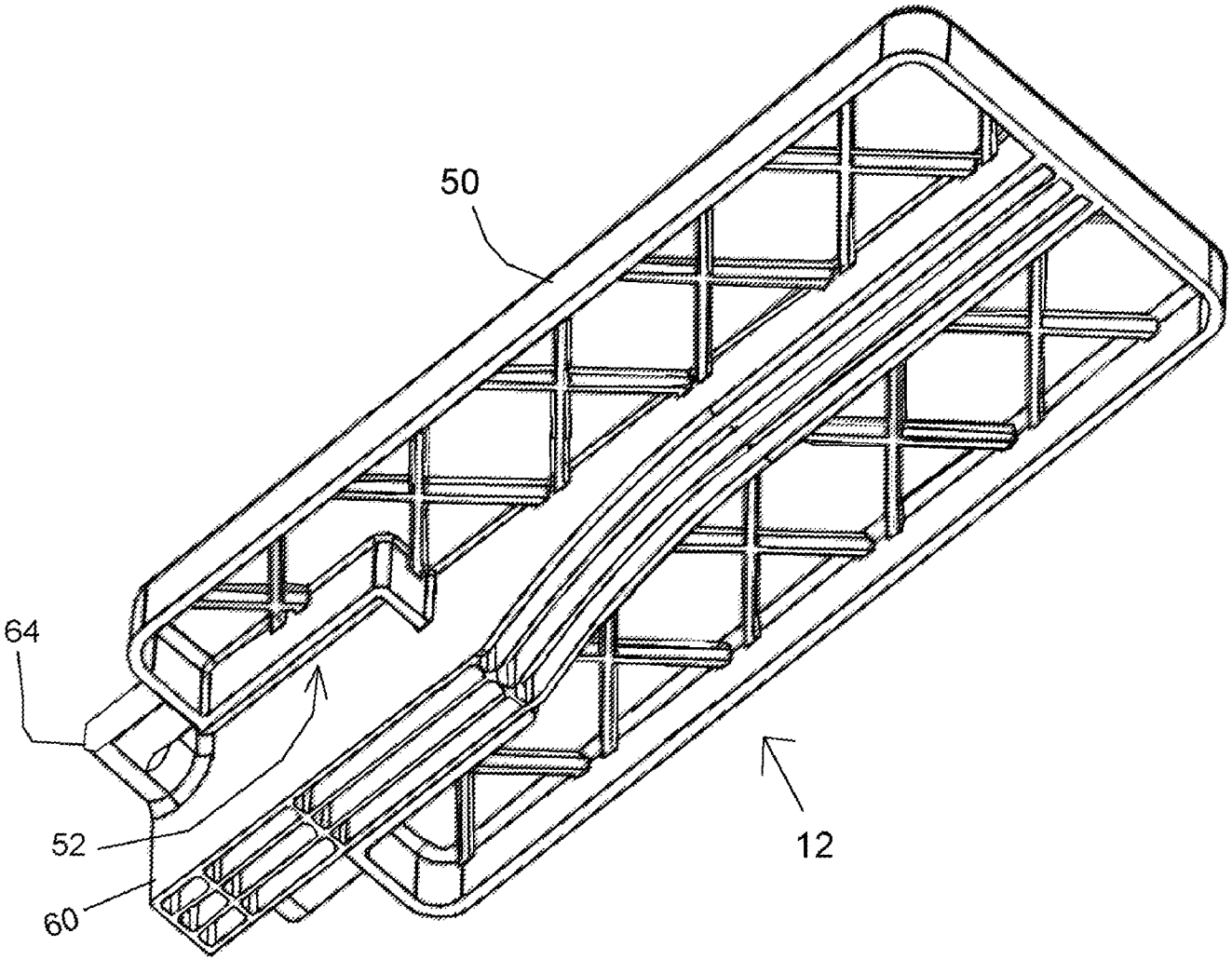
FIG. 3 is a perspective view of a seat according to the present invention.

The present invention is a cane seat assembly that can be mounted to an existing cane or a cane that is modified to receive the cane seat assembly. FIG. 1 shows components of an embodiment of a cane seat assembly that can be mounted to a cane. The components shown are a bracket assembly 10 and a seat 12. The bracket assembly 10 includes a first bracket half 14, a second bracket half 16, four bracket bolts 18, four wing nuts 20, and two push button quick release pins 22. Each bracket half 14, 16 incudes a main body 24 and a seat receiver end 26. The main body 24 mounts to a cane shaft 28 of a cane and includes four bolt holes 30, two pin holes 32, and a cane groove 34 on the inside surface of the main body 24. FIG. 2 shows an inside view of the first bracket half 14, which shows two seat engagement surfaces 36 as part of the main body 24. The seat engagement surfaces 36 are shown to travel at an angle from a midpoint 38 to endpoints 40. The seat receiver end 26 engages and supports the seat 12 and can include the use of various fasteners and shapes of the seat receiver end 26 in order to support the seat 12. An embodiment of the seat receiver end 26 is shown to include two seat cradles 42 which extend from the main body 24 of each bracket half 14,16. Each seat cradle 42 includes a U-shaped opening, retainer pin tab 44 and a seat lock tab 46. Each retainer pin tab 44 includes a pin hole 48. The two cradles 42 on each of the bracket halves 14,16 allows for easy mounting of the bracket assembly 10 without regard to orientation of the bracket assembly 10. The seat includes a seat surface 50, two bracket slots 52, support beam 54 and pin support 56, as shown in FIGS. 1 and 3. The pin support 56 extends up from the seat surface 50 with a pin cradle 58. The support beam 54 incudes a bracket engagement end 60. The seat 12 includes a tab engagement surface 62 as part of the seat surface 50 at the rear of the bracket slots 52. The rear end 64 of the seat 12 is rounded on the lower corner of the rear end 54 of the seat surface 50.

Figure 4:
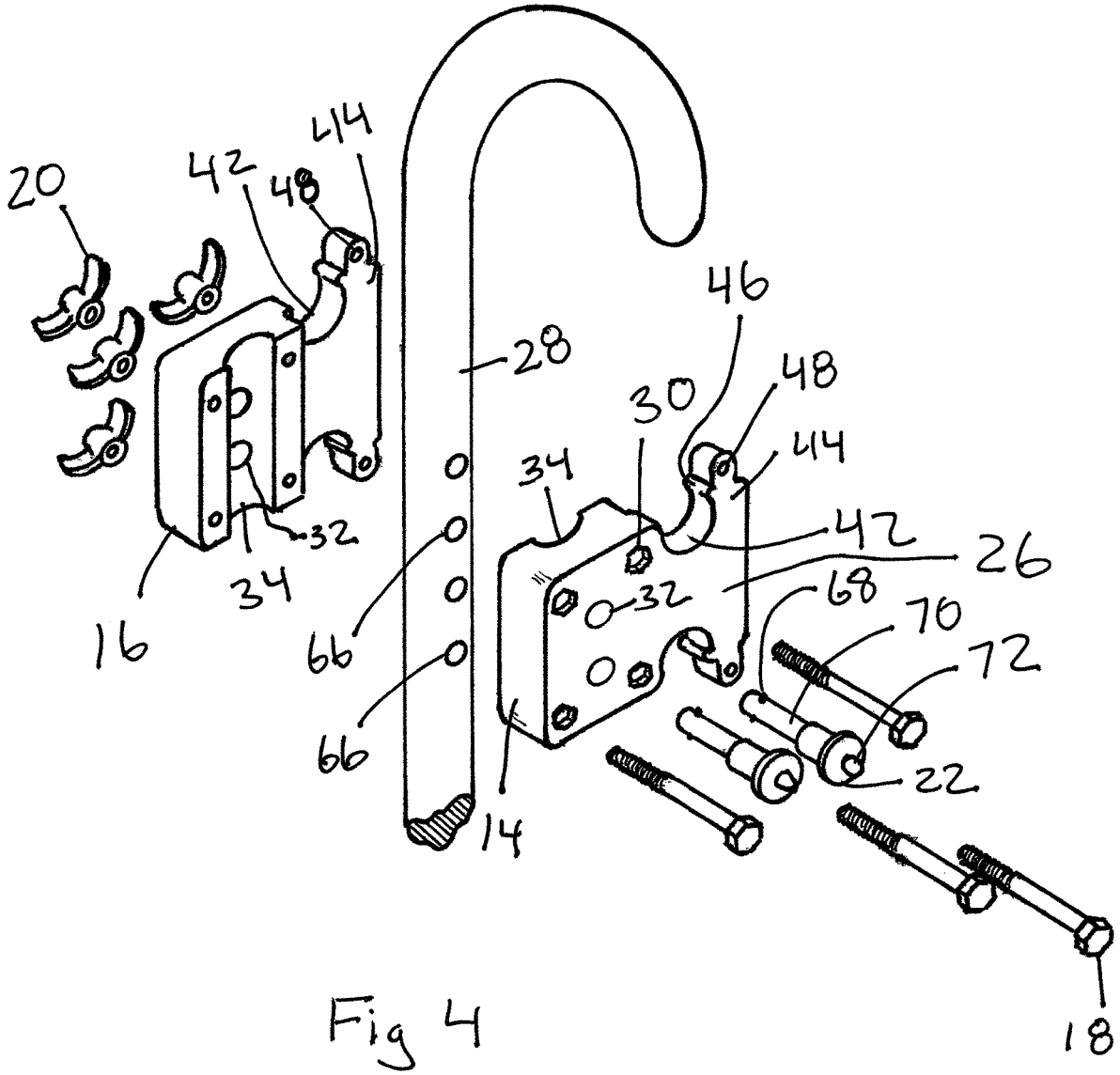
FIG. 4 is a exploded perspective view of a bracket assembly according to the present invention.
Figure 5:
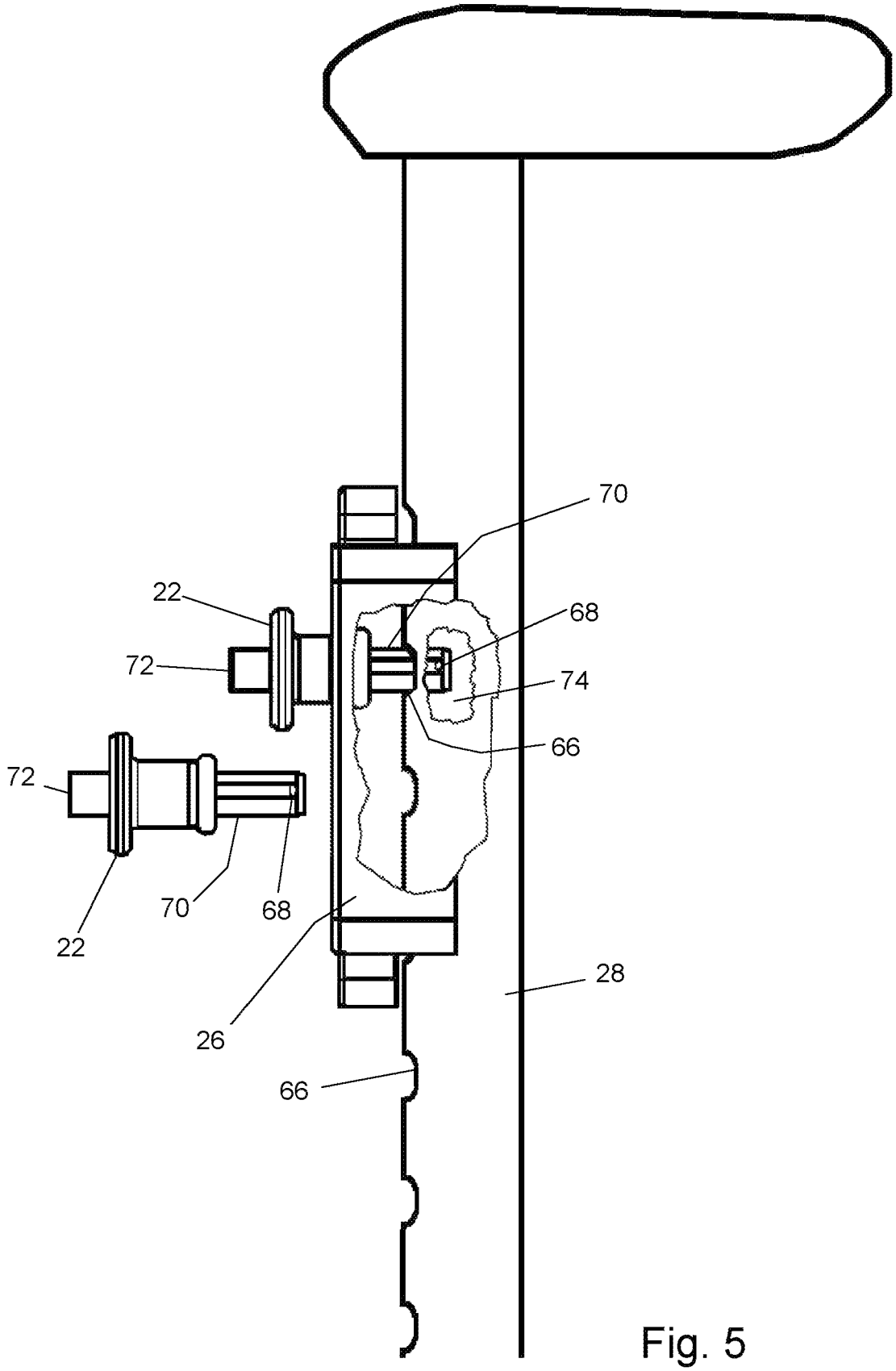
FIG. 5 is a side view of a bracket half on a cane according to the present invention.

FIG. 4 shows the attachment of the bracket halves 14,16 to the cane shaft 28 with holes 66 in the cane shaft 28. The cane shaft 28 fits in between the cane grooves 34 of the bracket halves 14,16. The four bolts 18 and wing nuts 20 secure the bracket halves 14,16 to the cane shaft 28. The two push button quick release pins 22 are inserted into the pin holes 32 of one of bracket halves 14,16 and engage two of the holes 66 of the cane shaft 28, as shown in FIG. 5. The pins 22 each include a catch 68 that extends out from a shaft 70 of the pin 22 and there is a push button 72 connected to the catch 68. When the push button 72 is activated, the catch 68 retracts toward the shaft 70 of the pin 22 to allow the pin 22 to be inserted into the pin hole 32 of the bracket half 14,16 and the hole 66 of the cane shaft 28. Once the pin 22 is in the hole 66 of the cane shaft 28, the push button 72 is released to allow the catch 68 to extend out from the shaft 70 of the pin 22 and engage the inside 74 of the cane shaft 28 in the area about the hole 66. The pins 22 provide strength to hold the bracket assembly in position on the cane when the cane seat assembly is under the weight of a user sitting on the seat 12. When the bracket assembly is mounted to the cane shaft 28, a seat beam slot 76 is formed between the seat receiver ends 26 of the two bracket halves 14,16.

Figure 6:
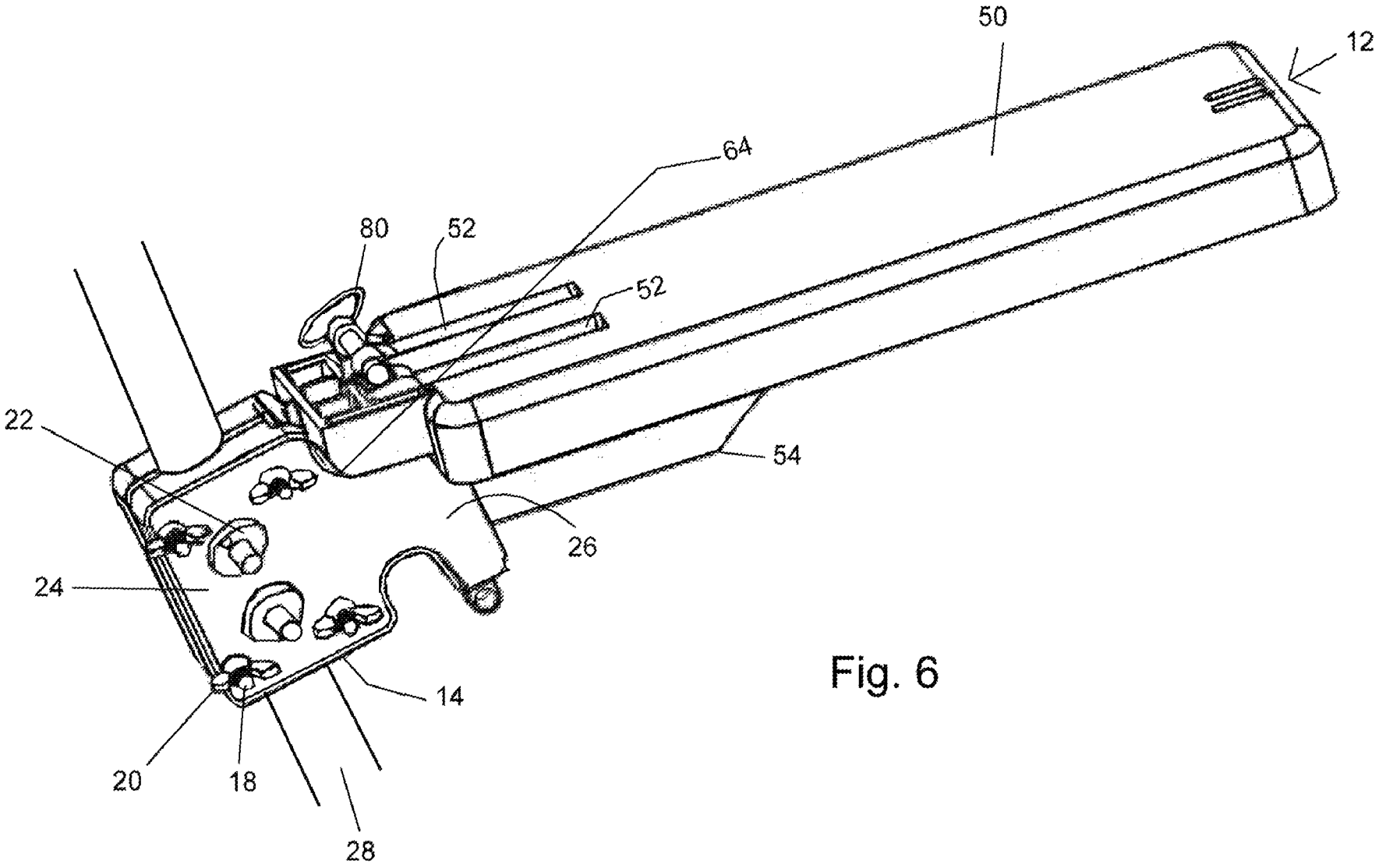
FIG. 6 is a perspective view of a cane seat assembly according to the present invention.
Figure 7:
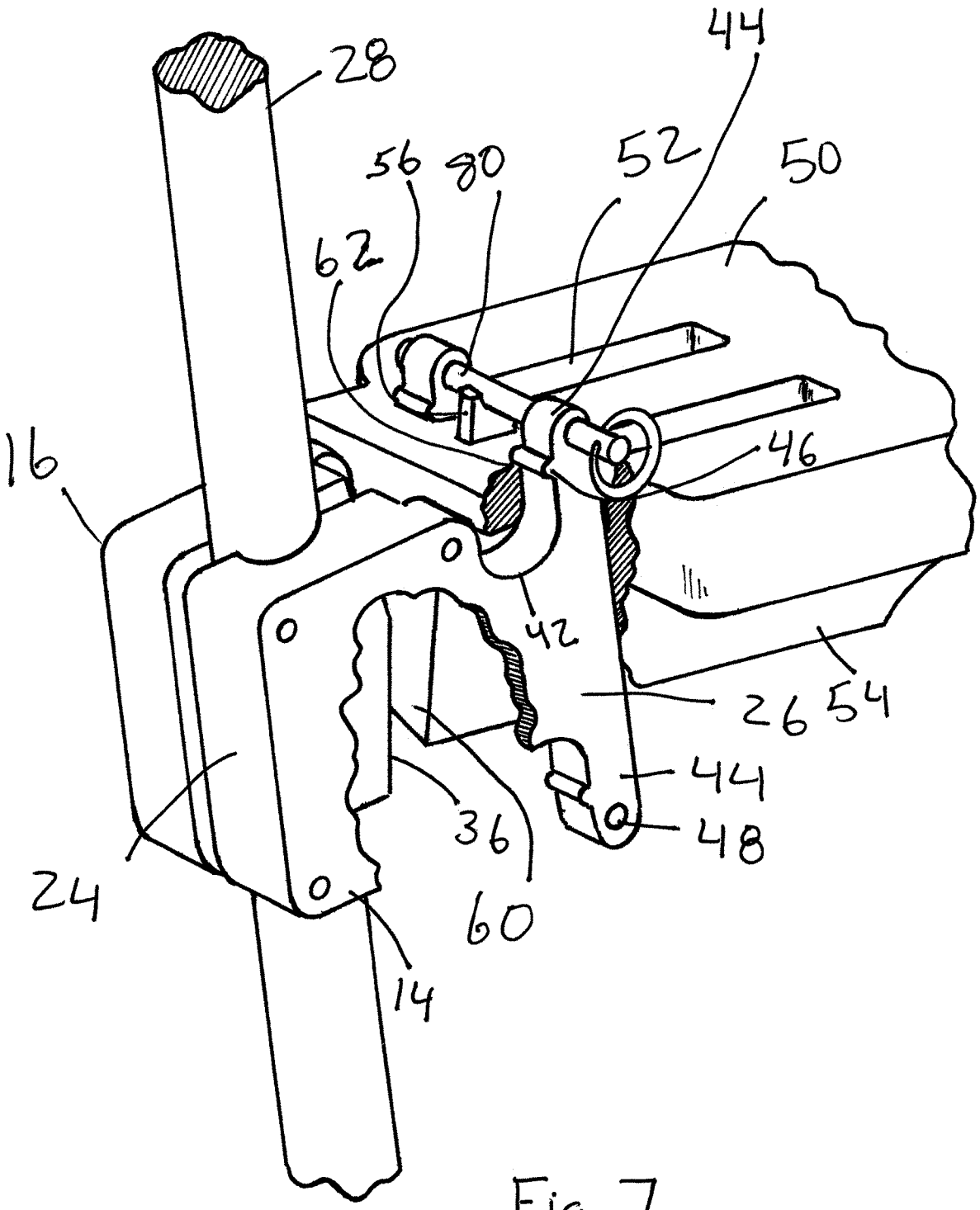
FIG. 7 is a perspective view of a cane seat assembly according to the present invention.
Figure 8:
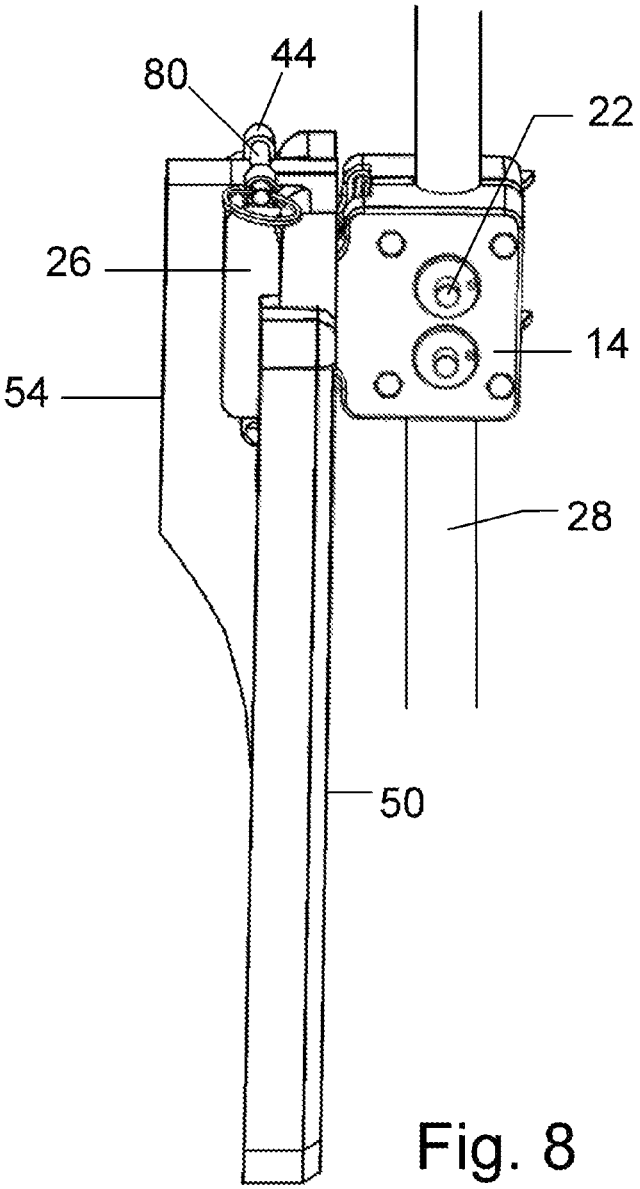
FIG. 8 is a side view of a cane seat assembly according to the present invention.

FIGS. 6-7 show the seat 12 mounted to the bracket assembly 10, when the bracket assembly 10 is on the cane shaft 28. The seat 12 is mounted to the bracket assembly 10 by slipping the rear of the seat 12 over the retainer pin tabs 44 of the seat cradles 42 and placing the bracket engagement end 60 of the seat beam 54 in seat beam slot 76. The retainer pin tabs 44 fit up through the bracket slots 52 of the seat 12 and the rear bottom 78 of the seat surface 50 rests in the U-shaped of the seat cradles 42. When the seat 12 is properly mounted to the bracket assembly, the bracket engagement end 60 of the seat beam 54 engages the lower of the seat engagement surfaces 36 of main body 24 of the bracket halves 14,16 for support. Also, the tab engagement surface 62 of the seat surface 50 engages under the seat lock tabs 46 of the cradles 42. A retainer pin 80 is inserted into one of the pin holes 48 of the retainer pin tabs 44, over the pin support 56 at the pin cradle 58 and into the other of the pin holes 48 of the retainer pin tabs 44 to lock the seat 12 to the bracket assembly 10. The U-shaped opening, retainer pin tab 42 and a seat lock tab 44 of the seat receiver end 26 and the bracket slots 52 are part of interface seat components for mounting the seat 12 to the bracket assembly 10. It is envisioned that other combination versions of interface seat components can be employed between the seat receiver end 26 and the seat 12 that engage each other using different fastening methods. The cane seat assembly can be used as a cane without the seat 12 attached or with the seat 12 attached as shown in FIG. 8. FIG. 8 shows the seat 12 is attached by placing the top 82 of the seat surface 50 towards the cane shaft 28 and placing the bracket slots 52 of the seat 12 over the retainer pin tabs 44 so that the seat 12 rests in the cradle 42. The retainer pin 80 is placed in the pin holes 48 of the retainer pin tabs 44 to hold the seat 12 in place.

Figure 9:
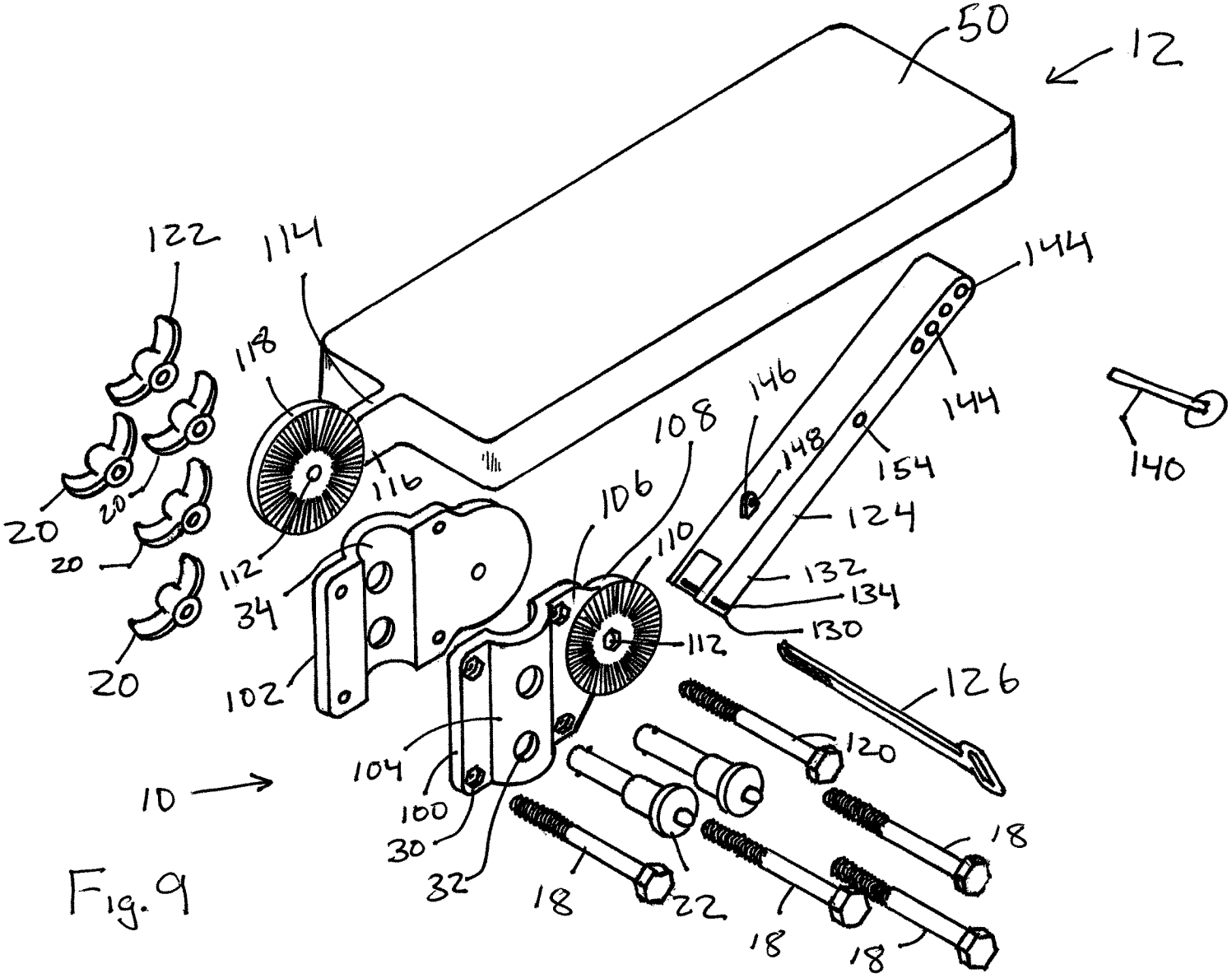
FIG. 9 is a perspective view of a cane seat assembly according to the present invention.

FIG. 9 shows components of another embodiment of a cane seat assembly that can be mounted to an existing cane. The components shown are a bracket assembly 10 and a seat 12. The bracket assembly 10 includes a first bracket half 100, a second bracket half 102, four bracket bolts 18, four wing nuts 20, and two push button quick release pins 22. Each bracket half incudes a main body 104 and a seat receiver end 106. The main body 104 mounts to a cane and includes four bolt holes 30, two pin holes 32, and a cane groove 34. The seat receiver end 106 engages and supports the seat 12. The seat receiver end 106 includes a bracket round splined surface 108 with teeth 110 on the outside surface of the seat receiver end 106 and a bolt hole 112 in the middle of bracket round splined surface 108. The seat 12 includes a seat surface 50 and bracket support end 114. The bracket support end 114 includes a support arm 116 with an arm round splined surface 118 with teeth 110 on one side and a bolt hole 112 in the middle of arm round splined surface 118. The bracket round splined surface 108 mates with the arm round splined surface 118 to mount the seat 12 to the bracket assembly 10, where the bolt holes 112 align to receive a seat bolt 120 and nut 122 assembly. The mating surface of teeth 110 of the bracket round splined surface 108 and the arm round splined surface 118 allows for adjustment of the angle that the seat 12 mounts to the seat receiver end 106. Other combinations of a support arm 116 from the seat 12 and the seat receiver end 106 of the bracket assembly 10 that engage each other are envisioned.

Figure 10:
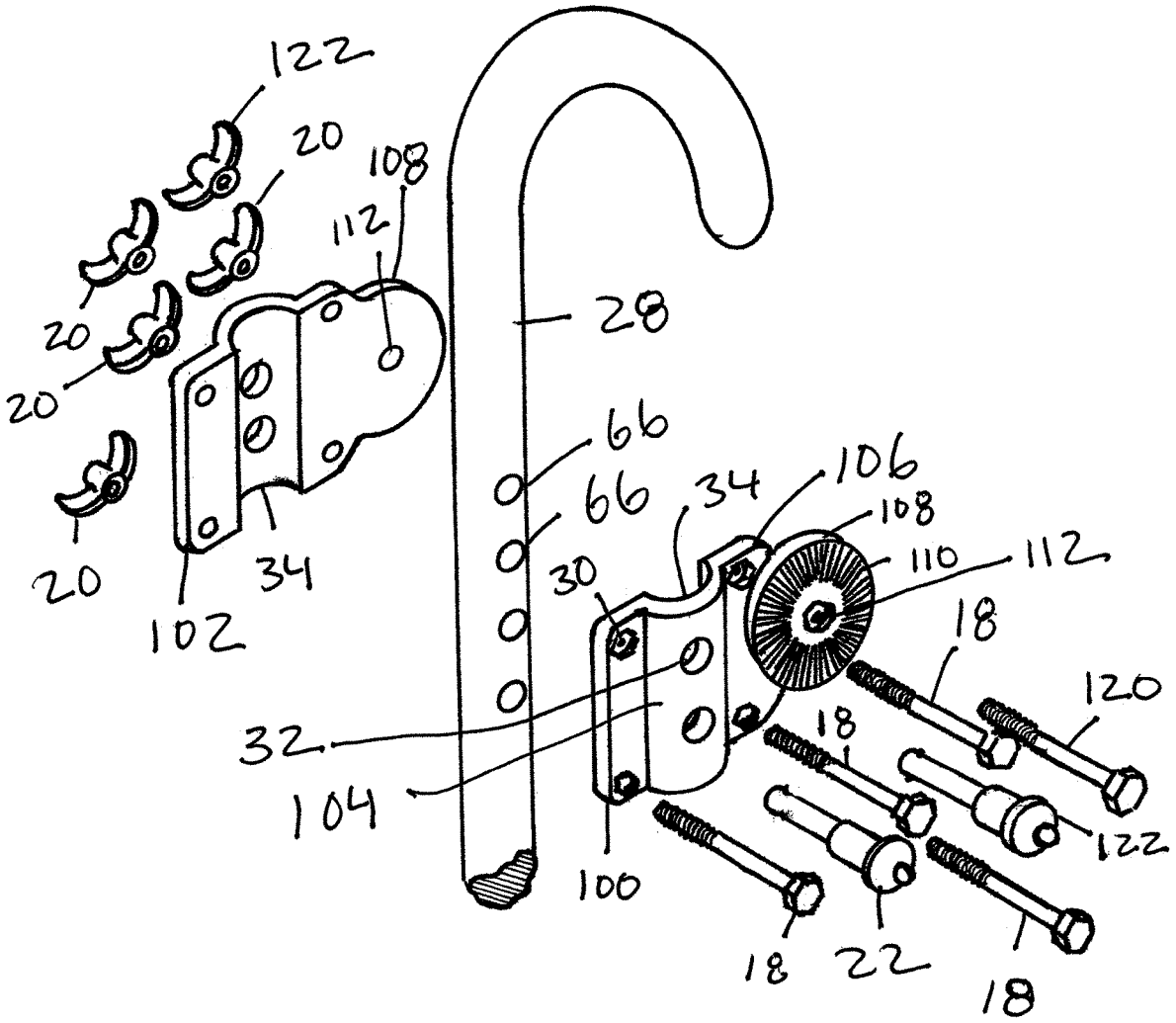
FIG. 10 is a exploded perspective view of a bracket assembly according to the present invention.
Figure 11:
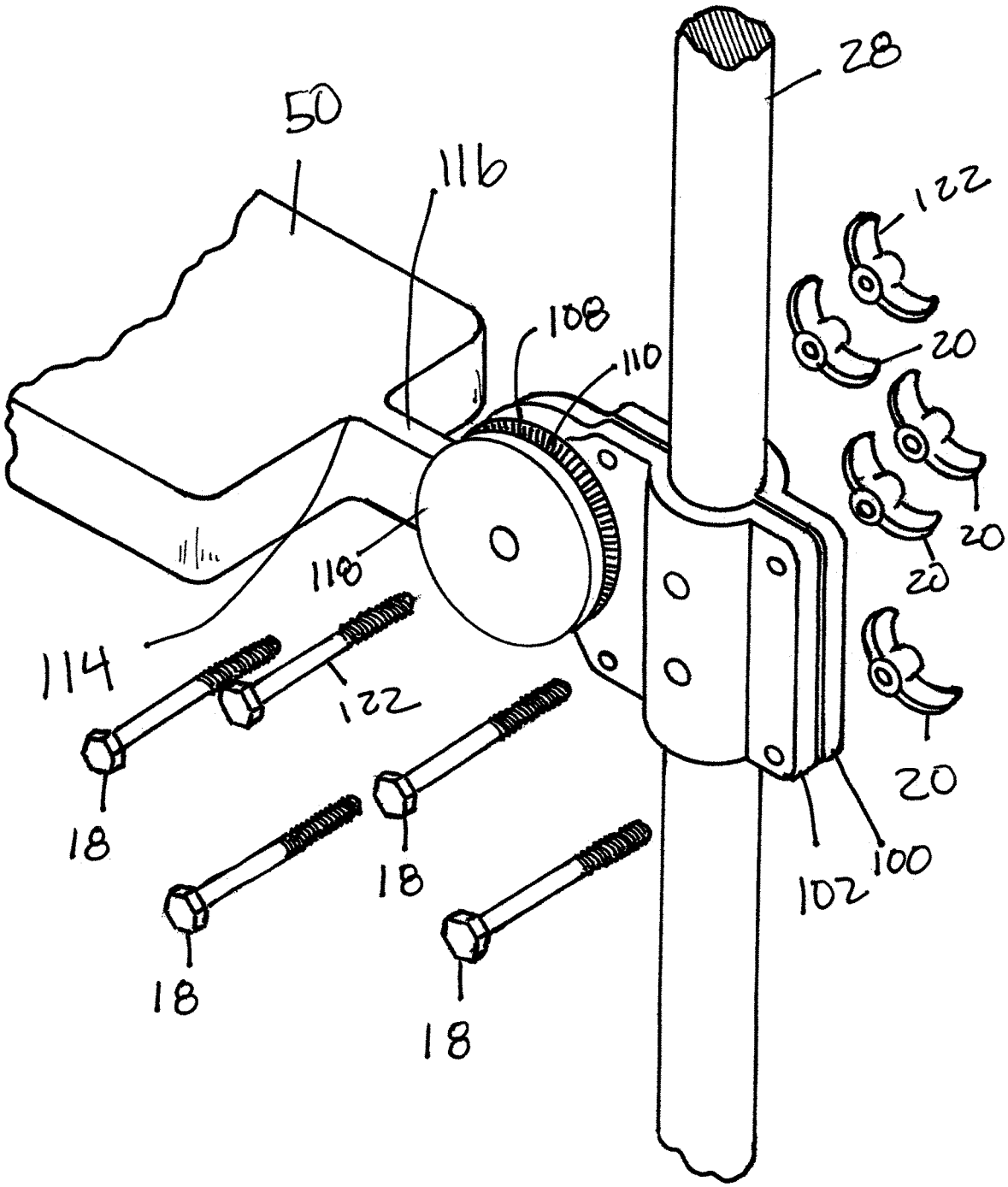
FIG. 11 is a perspective view of a cane seat assembly according to the present invention.

FIG. 10 shows both bracket halves 100,102 of the bracket assembly 10, which are secured together about the cane shaft 28. The cane shaft 28 fits in between the cane grooves 34 of the bracket halves 100,102. The four bracket bolts 18 and four wing nuts 20 secure the bracket halves 100,102 to the cane 28 shaft. The bracket round splined surface 108 on each of the bracket halves 100,102 allows for easy mounting of the bracket assembly 10 without regard to orientation of the bracket assembly 10. The two push button quick release pins 22 are inserted into the pin holes 32 of one of the bracket halves 100,102 and engage two of the holes 66 of the cane shaft in the same manner as shown in FIG. 5. The pins 22 provide strength to hold the bracket assembly 10 in position on the cane shaft 28 when the cane seat assembly is under the weight of a user sitting on the seat 12. The seat 12 mounts to the bracket assembly 10 by mating the bracket round splined surface 108 to the arm round splined surface 117 and inserting the bolt 120 into the bolt holes 112 and using the wing nut 122 to secure the bolt 120, as shown in FIG. 11.

Figure 12:
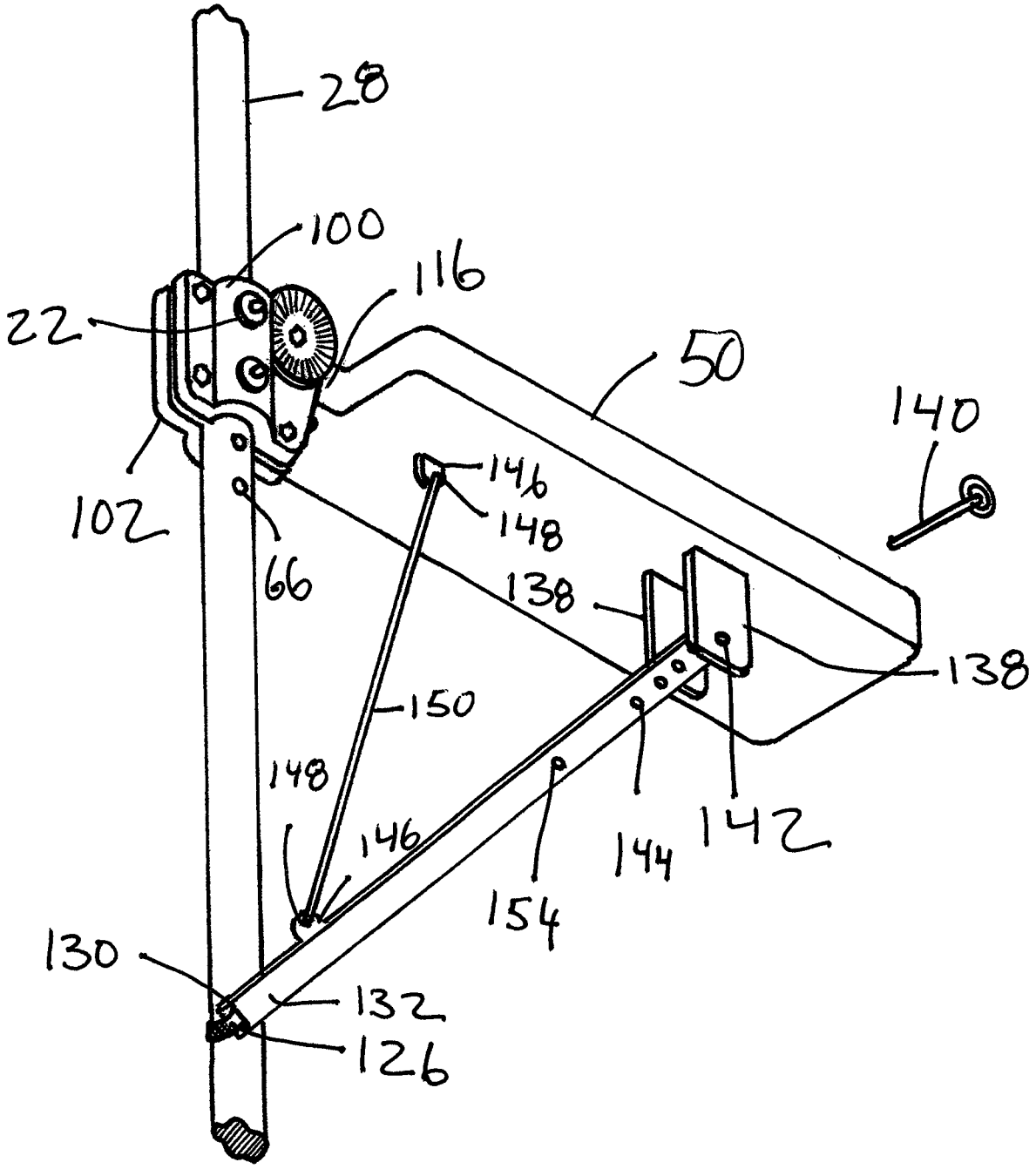
FIG. 12 is a perspective view of a cane seat assembly according to the present invention.
Figure 13:
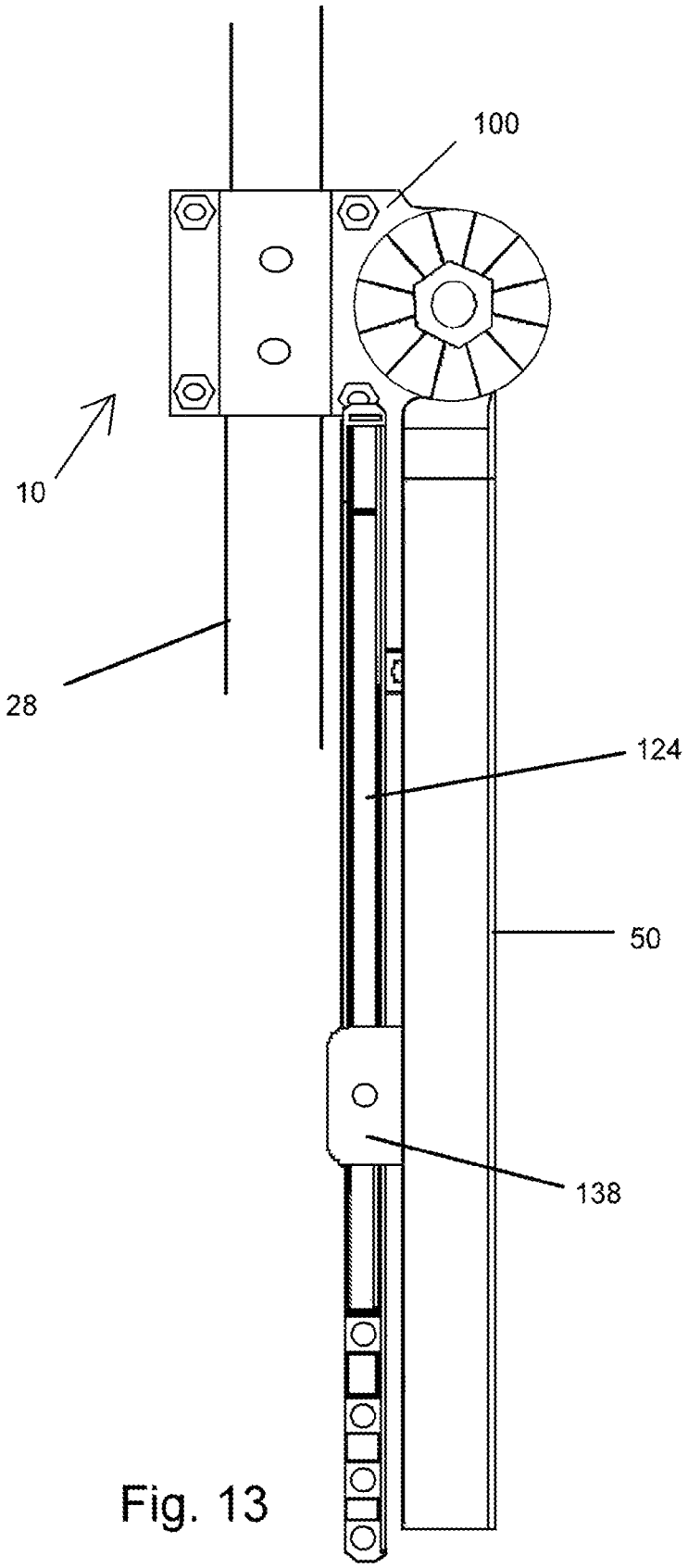
FIG. 13 is a side view of a cane seat assembly according to the present invention.

A brace bar 124 is included that mounts between the cane shaft 28 and the seat 12 to support the weight of the user, as shown in FIG. 12. The brace bar 124 is secured around the cane shaft 28 using a hook and loop strap 126 through cane tabs 130 extending from a cane end 132 of the brace bar 124. The cane tabs 130 include strap openings 134 to receive the strap 126. The brace bar 124 includes a seat end 136 that is secured to the seat 12 between the brace bar tabs 138 using a detent pin 140. The seat 12 includes the two brace bar tabs 138 that each have a pin hole 142. The brace bar 124 has multiple detent pin holes 144 use for mounting the seat 12 at different seat angles in relation to the cane shaft 28. The seat surface 50 can be positioned in relation to the cane shaft 28 in a range 90 degrees to 70 degrees for the best support of the weight of the user. The seat 12 and the brace bar 124 include tabs 146 with a hole 148 to attach a cord 150 between the tabs 146 to further secure the cane end 132 of the brace bar 124 from sliding down the cane shaft 28. The brace bar bracket round splined surface 108, and arm round splined surface 118 are part of interface seat components for mounting the seat 12 to the bracket assembly 10. It is envisioned that other combination versions of interface seat components can be employed between the seat receiver end 106 and the seat 12 that engage each other using different fastening methods. The cane seat assembly can be used as a cane without the seat 12 attached or with the seat 12 attached as shown in FIG. 13. FIG. 13 shows the seat 12 is attached by folding the seat 12 downward against the cane shaft 28 and placing the two brace bar tabs 138 about storage detent pin hole 154 on the brace bar 124. The detent pin 140 is placed through the two brace bar tabs 138 and storage detent pin hole 154 secure the seat 12 against the cane shaft 28.

Figure 14:
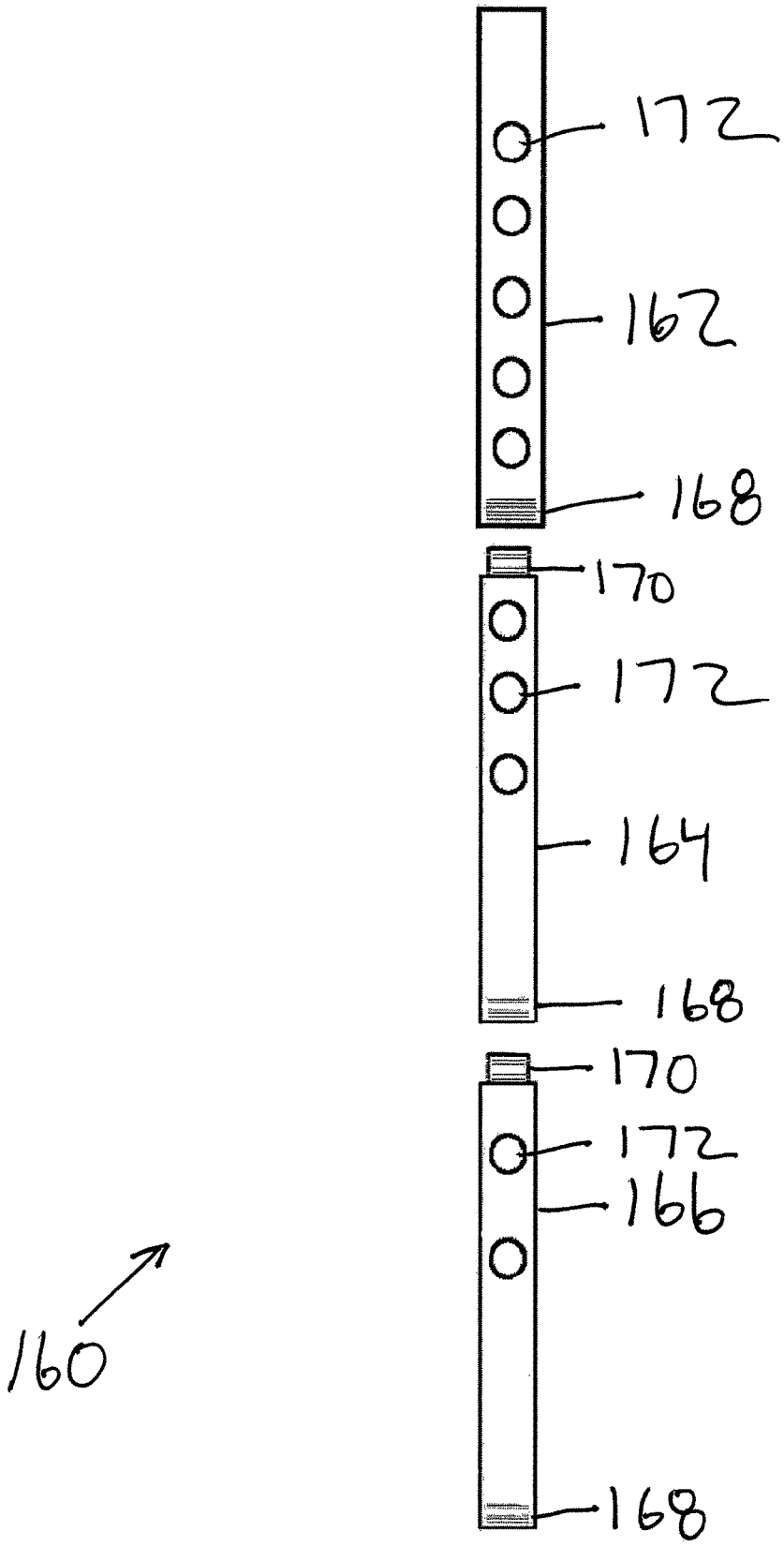
FIG. 14 is a side view of a support tube according to the present invention.

FIG. 14 shows a support tube 160 that breaks down into three sections 162, 164, and 166 for all of the embodiments of the cane seat assembly. A first section 162 includes internal threading 168 in a bottom end. The other two sections 164,166 include internal threading 168 in a bottom end and an external threaded top end 170. The top end of the two sections 164,168 thread into the bottom ends of the other sections to allow for disassembly to make the support tube 160 compact when needed. The support tube 160 includes pin holes 172 to align with pin holes 66 in the cane shaft 28. The support tube 160 is for canes that are made of lightweight materials such as aluminum that cannot support the weight of the user on the cane shaft 28 and will cause the cane shaft 28 to bend. The support tube 160 can be placed inside the cane shaft 28 to provide addition support to prevent the cane shaft 28 from bending under the weight of the user.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A cane shaft seat assembly adapted to be mounted on a cane shaft used to provide support to a user, comprising:

a seat adapted to provide a surface to support the user in a sitting position;

a bracket assembly adapted to be mounted to the cane shaft, said bracket assembly configured to receive and support said seat at least one cane shaft pin; said bracket assembly includes at least one cane shaft mount pin hole to receive said cane shaft pin, wherein said cane shaft mount pin hole is adapted to align with a cane shaft pin hole in the cane shaft; and support tube including at least one cane pin hole, whereby said support tube is adapted to mount within the shaft and configured to translate with respect to said seat and said bracket along a length of the shaft and is configured to be held in position by said at least one cane shaft pin such that said support tube provides structural support to the shaft at a positon along the shaft subject to increased bending forces.

2. A shaft seat assembly adapted to be mounted on a shaft used to provide support to a user, comprising:

a seat adapted to provide a surface to support the user in a sitting position;

a bracket assembly adapted to be mounted to the shaft, said bracket assembly configured to receive and support said seat.

said bracket assembly includes a first bracket half and a second bracket half, fasteners to fasten said first bracket half and said second bracket half together about the shaft; wherein said first bracket half and said second bracket half each include a shaft groove adapted to receive the shaft; wherein said first bracket half and said second bracket half each include a main body and a seat receiver end, said seat mounts to said seat receiver end which engages and supports said seat, said seat receiver end including a seat engagement surface extending from said seat receiver end to provide support for said seat; and said seat includes a bracket engagement end having a face which is angled with respect to said surface to support the user in a sitting position extending from said seat, said face engages said seat engagement surface of said seat receiver end so that said seat engagement surface supports said seat.

3. The shaft seat assembly of claim 2, wherein said seat engagement surface is angled and abuts said face of said bracket engagement end to position said seat with respect to the shaft when said seat is mounted to said bracket assembly.

4. A shaft seat assembly adapted to be mounted on a shaft used to provide support to a user, comprising:

a seat adapted to provide a surface to support the user in a sitting position;

a bracket assembly adapted to be mounted to the shaft, said bracket assembly configured to receive and support said seat;

said bracket assembly includes a first bracket half and a second bracket half, fasteners to fasten said first bracket half and said second bracket half together about the shaft; wherein said first bracket half and said second bracket half each include a shaft groove adapted to receive the shaft; wherein said first bracket half and said second bracket half each include a main body and a seat receiver end, said seat mounts to said seat receiver end which engages and supports said seat, said seat receiver end including a seat engagement surface extending from said seat receiver end to provide support for said seat; and wherein said seat receiver end includes at least one seat cradle which extends from said main body of each of said bracket halves, said seat cradle includes a U-shaped opening and retainer pin tab; wherein said seat includes a support arm to engage said seat receiver end, said support arm including a bracket slot to slip over each retainer pin tab to engage said support arm to said seat cradle.

5. The shaft seat assembly of claim 4, wherein said seat cradle includes a seat lock tab; and wherein said seat includes a tab engagement surface to engage under said seat lock tab.

6. The shaft seat assembly of claim 4, further including a retainer pin and wherein each retainer pin tab includes a pin hole to receive said retainer pin to lock said seat in position for sitting.

7. The shaft seat assembly of claim 4, wherein said seat includes a seat support beam, wherein a seat beam slot is formed between said seat receiver ends of said two bracket halves to receive said seat support beam.

8. The shaft seat assembly of claim 7, wherein said main body includes at least one seat engagement surface to engage said seat support beam, said at least one seat engagement surface positions said seat in relation to the cane when said seat is mounted to said bracket assembly.

* * * * *